US006009688A

United States Patent [19]

Pedersen et al.

[11] Patent Number: 6,009,688

[45] Date of Patent: Jan. 4, 2000

[54] SYSTEM FOR PACKAGING AND STORING SPECIALTY LIGHTING AND ELONGATED ITEMS OF NARROW WIDTH

[76] Inventors: Stephen F. Pedersen; Kathy J. Rygle, both of P.O. Box 313, Cheswick, Pa. 15024-0313

[21] Appl. No.: 09/189,687

[22] Filed: Nov. 10, 1998

[51] Int. Cl.[7] ..... B65B 43/54

[52] U.S. Cl. ..... 53/399; 53/459; 53/576; 53/585; 53/413

[58] Field of Search ..... 53/399, 417, 576, 53/567, 585, 459, 413; 29/235; 206/419, 420

[56] References Cited

U.S. PATENT DOCUMENTS

| | | | |
|---|---|---|---|
| 1,949,298 | 2/1934 | Fabel | 53/459 |
| 2,741,884 | 4/1956 | Best | 53/198 |
| 2,847,805 | 8/1958 | Robbins | 53/576 |
| 2,989,828 | 6/1961 | Warp | 53/576 |
| 3,380,220 | 4/1968 | Jennings | 53/567 |
| 4,104,774 | 8/1978 | Overmyer | 53/413 |
| 4,280,314 | 7/1981 | Stuck | 53/241 |
| 4,324,087 | 4/1982 | Mitchell et al. | 53/241 |
| 4,987,724 | 1/1991 | Rutherford | 53/399 |
| 5,064,970 | 11/1991 | Bennett | 174/135 |
| 5,293,501 | 3/1994 | Bennett | 174/135 |

*Primary Examiner*—John Sipos

[57] ABSTRACT

A method for packaging specialty lighting strings and elongated items of narrow width, especially useful for specialty light strings which contain large, bulky decorative light covers or complicated patterns such as icicle lights. Scarves, decorative garland, ties, and lawn ornaments may also be packaged effectively. Items are passed through a cylinder of rigid material on which a quantity of thin plastic tubing is compressed. Once the item emerges out the end of the cylinder, the beginning of the plastic tubing is secured to the end of the item with a twist tie. The end is then grasped and the item is pulled completely through the cylinder. As it comes through, it is encased in the plastic tubing which unravels from the cylinder. Once through, the end of the item is secured to the tubing with a twist tie and the tubing is cut. Thus a completely packaged item which may be stored dust and tangle free.

15 Claims, 8 Drawing Sheets

Figure 3
Figure 3a
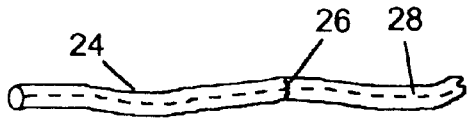
Figure 3b
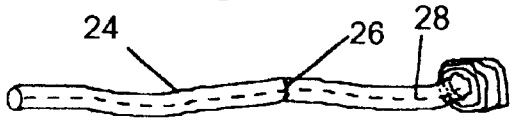
Figure 3c
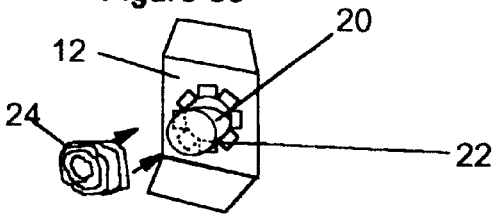
Figure 4
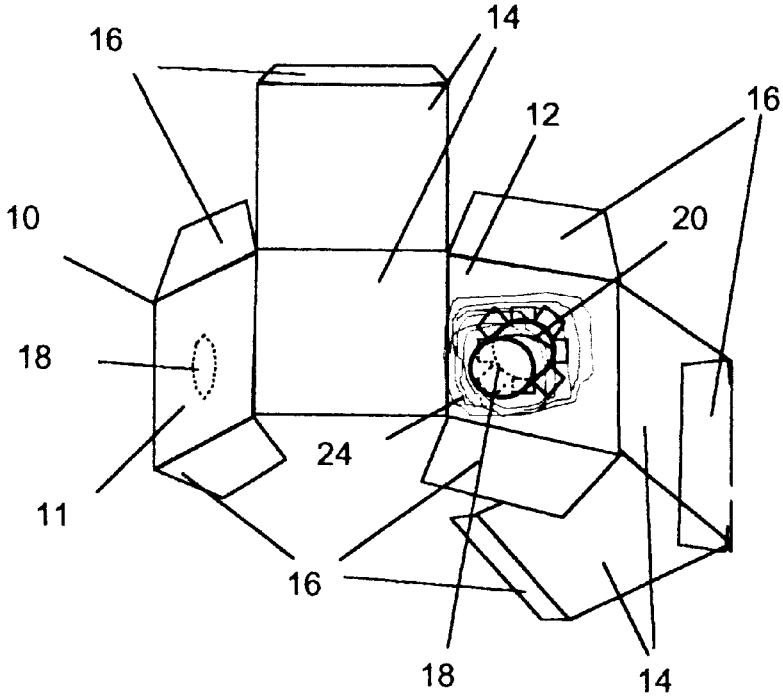

Figure 9
Figure 9a
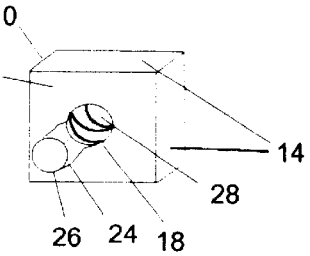
Figure 9b
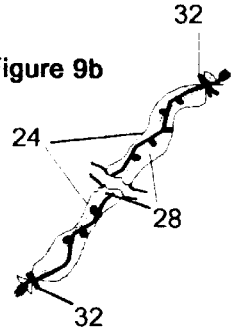
Figure 10
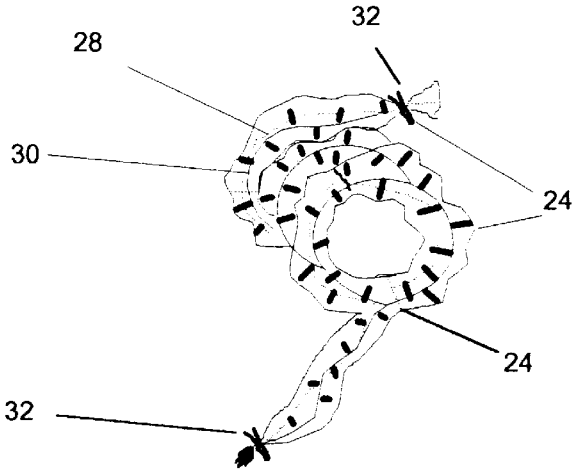
Figure 11
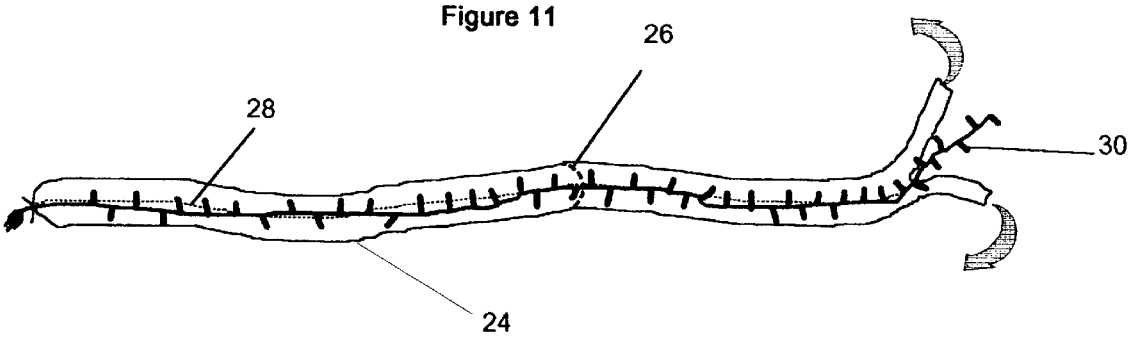

Figure 12
Figure 12a
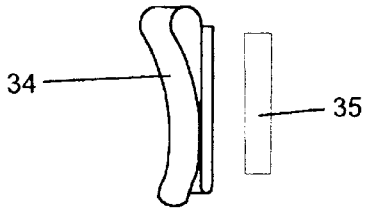
Figure 12b
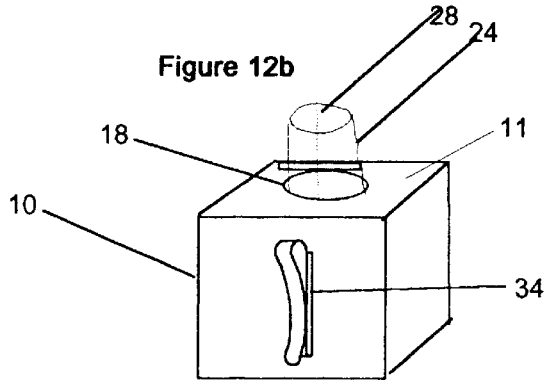
Figure 12c
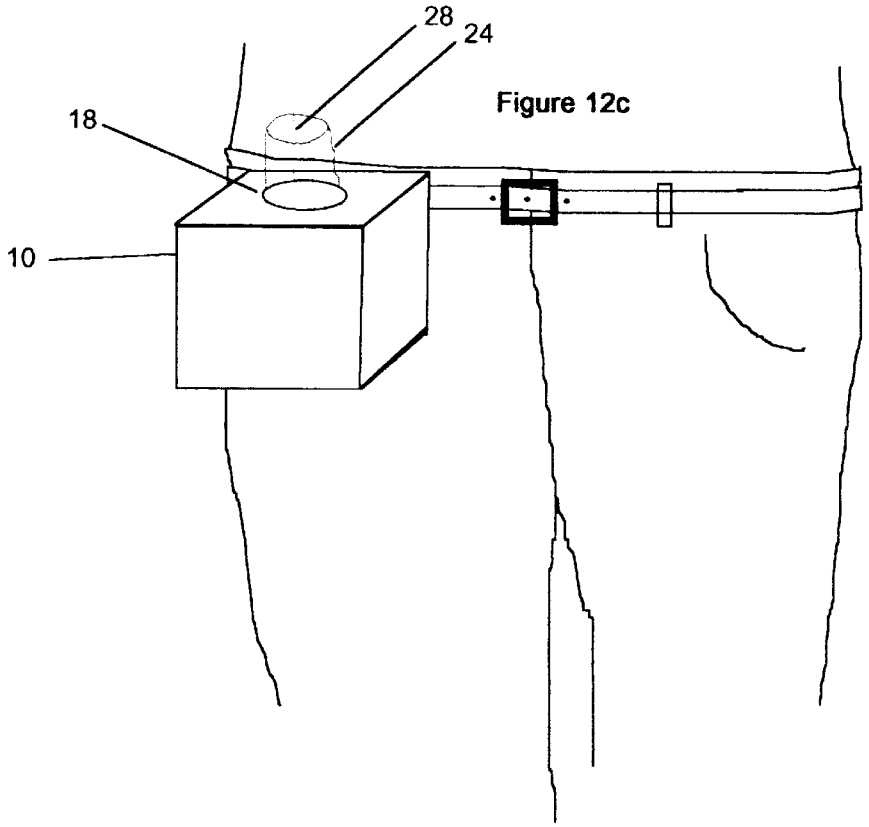

Figure 13
Figure 13a
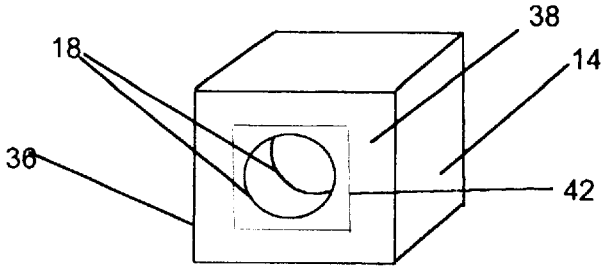
Figure 13b
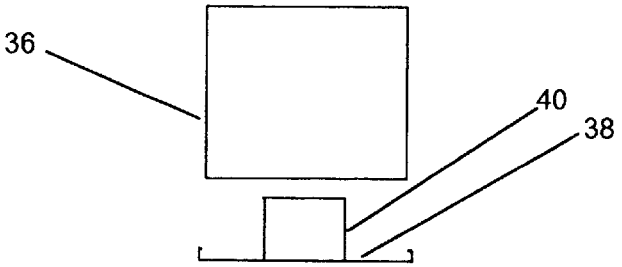
Figure 13c
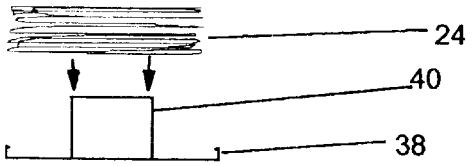
Figure 13d
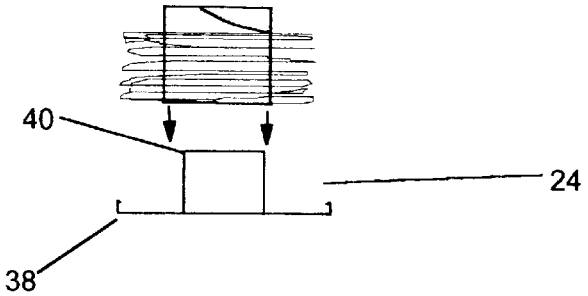

Figure 14
Figure 14a
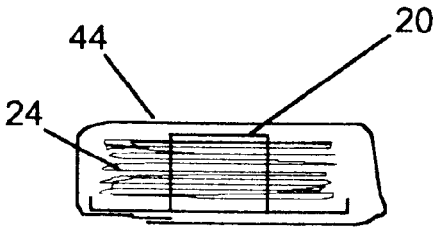
Figure 14b
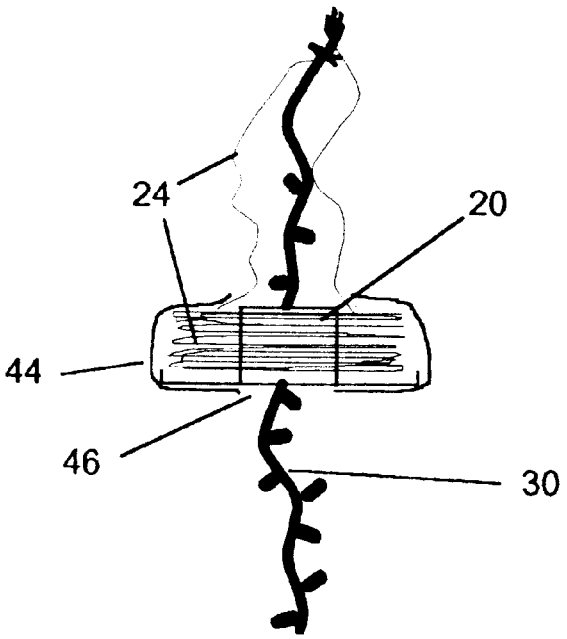

SYSTEM FOR PACKAGING AND STORING SPECIALTY LIGHTING AND ELONGATED ITEMS OF NARROW WIDTH

BACKGROUND—FIELD OF INVENTION

This invention relates to the packaging of specialty light strings and elongated items of narrow width.

BACKGROUND—DESCRIPTION OF PRIOR ART

In all of their continually changing forms, decorative electric lights are the uniquely American contribution to the Christmas Tree. It was Christmas of 1882, just three years after Thomas Alva Edison first demonstrated his invention, the electric light bulb, that the world's first electrically lighted Christmas tree was "born". It was displayed in the home of Edward Johnson, vice president of the newly formed Edison Electric Company. Within a few years, Edison's company expanded to include the manufacture of miniature bulbs for decorative purposes. The invention of the light string occurred in 1903 at the Ever-Ready Company. And, it was with this invention that the age-old quest to solve the problem of the tangled light string began. Over the years, shapes and sizes of lights and the design of light strings have changed. In 1936, Disney characters first appeared on Christmas lights; in 1945, it was bubble lights, and 1997 saw the introduction of icicle lights.

In recent years, decorative light strings have made appearances for other holidays, not just for Christmas. Trees and houses are aglow with lights shaped like pumpkins and ghosts at Halloween; hearts at Valentine's Day, shamrocks for St. Patrick's Day, and eggs and bunnies at Easter. And don't forget the miniature patio lights for summer night entertaining on the deck. Novelty is the key to increased sales in holiday lights, each year bringing new variations, and along with them unique problems of storage and tangling.

A search of prior art for devices intended to solve the problem of decorative light storage turned up many U.S. Patents such as U.S. Pat. Nos. 5,482,226; 5,287,965; 5,691,075; 5,458,541; 5,526,931; 5,597,070; and 5,168,999. However, the devices covered under these prior art patents use storage methods designed primarily for light strings with small light bulbs, and are not really applicable to light strings with large, bulky, odd shaped light covers or light strings with secondary branching light strings such as the "icicle" lights. U.S. Patents such as U.S. Pat. Nos. 5,482,226, 5,287,965, 5,691,075, 5,458,541, and 5,526,931 all employ some form of device, such as a reel, on which the light string is wound. Lights which have been stored on the reel still tangle, and can get dusty during storage. U.S. Pat. Nos. 5,597,070 and 5,168,999 utilize a storage rack typically used for packing new light strings for sale. Remounting the light string back into these racks for storage after use is an excercise requiring a great deal of patience. All of the patents mentioned above do not present prior art for our invention, but illustrate the efforts which have been made to solve the decorative light storage problem, and the problems which remain with these proposed solutions.

U.S. Pat. No. 4,987,724 is for a device similar to our invention in one aspect; it uses a plastic sleeve to encase a light string. But that is the only similarity. This example proposes to use an 8-foot long "serpentine pulling tool", one end of which is to be attached to an immovable object (such as a doorknob). The plastic sleeve (which must be long enough to cover the string of lights) is pulled over the "serpentine pulling tool", and the other end of the pulling tool is attached to one end of the string of lights. The plastic sleeve is then pulled over the string of lights, which are then detached and stored. To use the lights next, the process is reversed; the string of lights is attached to the pulling tool, and the plastic sleeve is pulled off the light string and onto the pulling tool, so the light string can be used. This system appears to be awkward and time-consuming for the average consumer.

U.S. Pat. Nos. 4,280,314, 4,324,087, and 2,741,884 were also examined. U.S. Pat. Nos. 4,280,314 and 2,741,884 use a pulling device to insert an article into a tube-like container. U.S. Pat. No. 4,324,087 is a garment bagging system which use a complicated apparatus to pull an article of clothing into a bag.

Two more recent U.S. Patents which reference U.S. Pat. No. 4,987,724 are U.S. Pat. Nos. 5,064,970 and 5,293,501. Both of these patents deal with enshrouding a wiring harness where a stretchable cloth is put onto an applicator. A precut length of stretchable material is placed over the applicator, and the applicator is passed over the wiring harness, transferring the shrouding from the tubular applicator to the wiring harness. The purpose of the shroud is to facilitate installation of the wiring harness through holes in the body of a car. While the idea of placing a length of material over a wiring harness is similar to our invention, our invention does not use any kind of applicator tube, but rather stores the plastic tubing, which is the material covering the item to be stored, on a cylinder in a box, or covered with shrinkwrap plastic, where it is ready to be placed over the item to be stored, and cut or torn at a length appropriate to the item.

Our invention is designed to be a simple hand held device which can be used to package almost any form of light string, be it one with large bulky decorative covers, multiple secondary light stings, or the standard colored light bulb, or any other narrow, long object. Our invention is designed to be a simple hand held device which can be used to package almost any form of light string, be it one with large bulky decorative covers, multiple secondary light strings, or the standard colored light bulb, or any other narrow, long object. A light string is inserted by hand through the opening of a cylinder of varying diameter which may or may not be enclosed in a box. As the beginning of the string is pulled by hand out of the opposite opening in the cylinder, the top of the plastic tubing previously compressed on the outside of the cylinder is pulled off and attached to the end of the string of lights by means of a twist-tie. As the light string is pulled through the cylinder, the tubing uncompresses and covers the light string. When the end of the string emerges from the cylinder, the tubing is cut or tom at a cross perforation and a twist tie used to secure the end of the plastic tubing to the end of the string. The plastic covered light string can be coiled and hung or stored in a box and it won't tangle. The lights are kept dust free and if the decorative light cover comes, off, as they have a tendency to do, they are safely contained until removal. To use the light string again, one simply pulls or cuts off the tubing, or tears it along a perforation. The design also has application to packaging elongated items of narrow width, such as ties, scarves, wind socks, flags, and similar items.

OBJECTS AND ADVANTAGES

Accordingly, several objects and advantages of our invention are:

(a) to provide a convenient, easy-to-use method of packaging specialty light strings and elongated items of narrow width;

(b) to provide a method of packaging elongated items such as ornamental garlands, scarves, ornamental flags, ties, and similar objects when they are not in use;

(c) to provide a method of storing specialty light strings which will eliminate tangles in the stored lights;

(d) to provide a method of packaging and storing specialty light strings and elongated items of narrow width which maintains the items in a clean protected storage unit;

(e) to provide a method of storing specialty lights and elongated items of narrow width which can be easily removed when the item is to be used again.

Since this is a unique method of packaging, further objects and advantages will become apparent from a consideration of the drawings and ensuing description.

DRAWING FIGURES

In the drawings, closely related figures have the same number but different alphabetic suffixes.

FIG. 3*a* shows the plastic tubing with optional perforations cut around the circumference at intervals and along the length from beginning to end. FIG. 3*b* shows the tubing being compressed.

FIG. 3*c* shows the compressed tubing being placed over the cylinder mounted in the box.

FIG. 4 shows the rigid material being folded to make the box, with the cylinder and compressed plastic tubing mounted in place.

Figure 5:
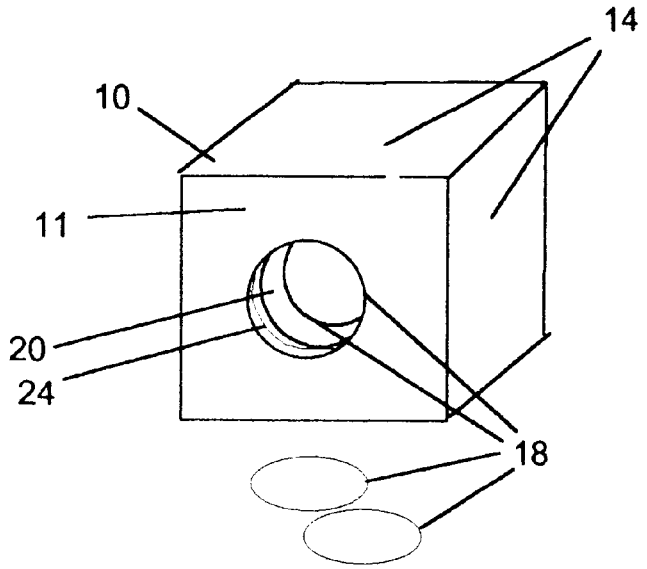

FIG. 5 shows the folded box, with the perforated circles opened to form holes.

Figure 6:
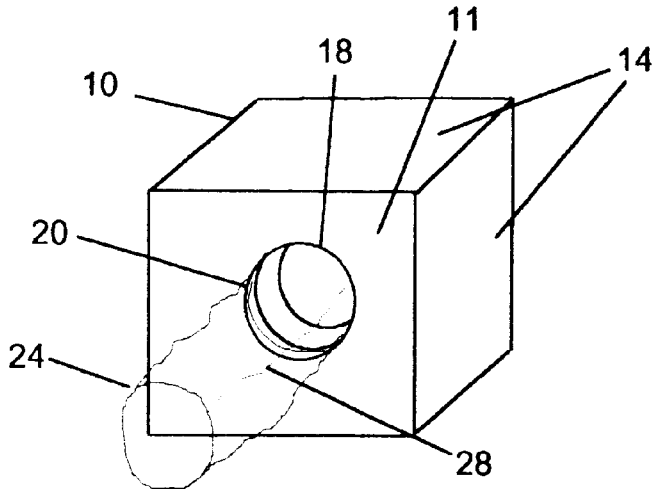

FIG. 6 shows the beginning end of the plastic tubing being pulled through the opening in the top of the box.

Figure 7:
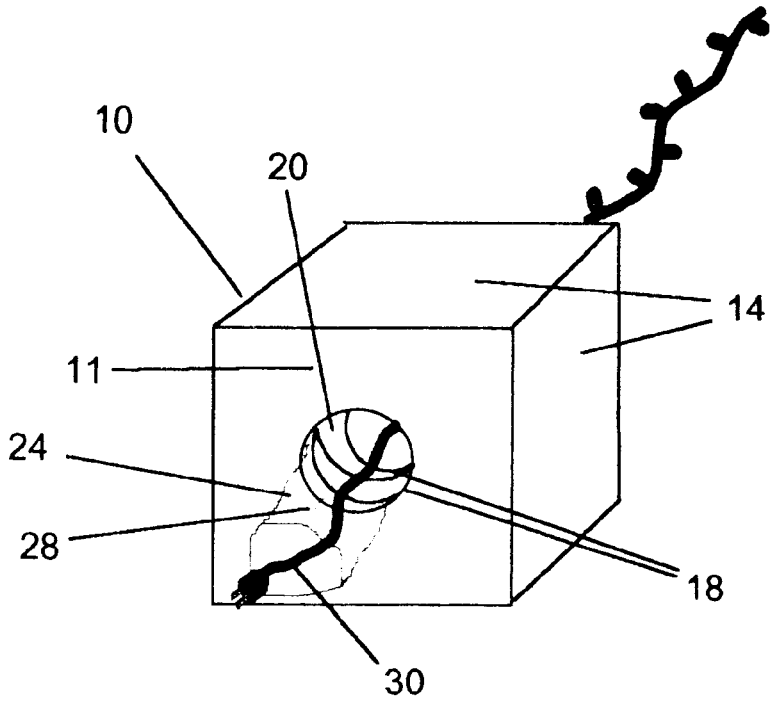

FIG. 7 shows the light string being inserted through the opened hole on the bottom of the box and through the cylinder, and finally pulled through the beginning end of the plastic tubing which has been pulled through the hole in the top of the box.

Figure 8:
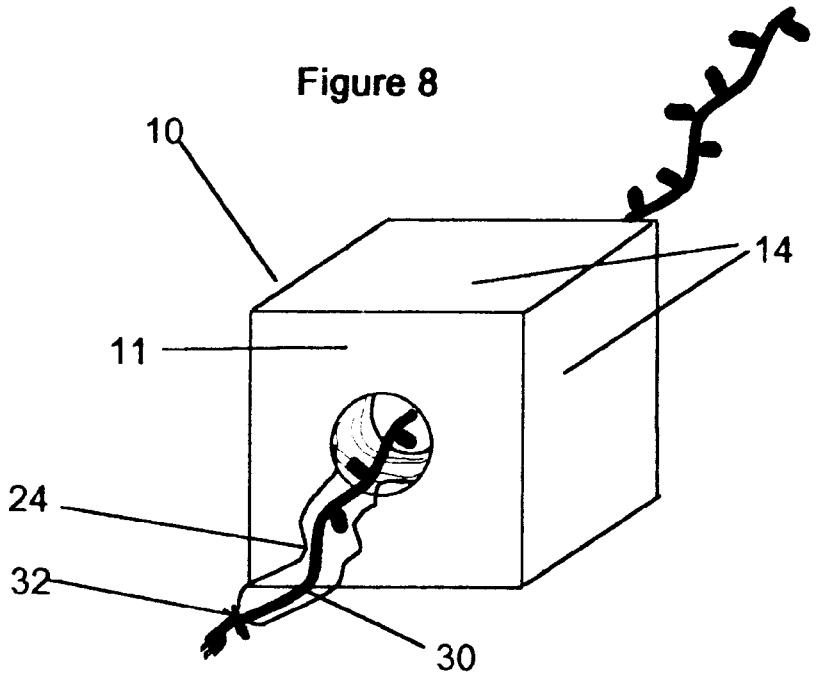

FIG. 8 shows the plastic tubing being secured to the beginning of the light string by a twist-tie.

FIGS. 9*a* and 9*b* shows the plastic tubing covering the light string after it has been pulled completely through the box. The plastic tubing has been cut or torn at the optional circumferential perforation directly after the end of the light string and secured to the light string by another twist-tie.

FIG. 10 shows the string of lights covered with the plastic tubing and coiled for storage.

FIG. 11 shows the plastic tubing being torn at the optional longitudinal perforation and removed from the string of lights in preparation for use after storage.

FIGS. 12*a*–12*c* shows an optional belt or pocket clip and it's use.

FIGS. 13*a*–13*d* shows an alternative construction from plastic for the box.

FIGS. 14*a* and 14*b* shows an alternative shrinkwrap covering in place of the box.

REFERENCE NUMBERS IN DRAWINGS

10 Form for box (construction materials are optional; dimensions may vary).
11 Top section of box
12 Bottom sections of box.
14 Side sections of box
16 Tabs of box
18 Perforated hole in box (through which the string of lights will pass). (Dimensions may vary).
20 Cylinder of rigid material.
22 Mounting tabs on cylinder of rigid material.
24 Plastic tubing which covers lights for storage (dimensions may vary).
26 Optional perforations around the circumference of the plastic tubing.
28 Optional perforations along the length of the plastic tubing.
30 String of lights to be covered for storage.
32 Twist-ties to secure plastic tubing to beginning and end of string of lights.
34 Pocket or belt clip.
35 Tape with adhesive on both sides.
36 Plastic box.
38 Removable bottom on box.
40 Plastic tube.
42 Removable cellophane closure.
44 Plastic shrinkwrap covering with perforated center holes.

SUMMARY

This invention provides a method of packaging specialty light strings and elongated items of narrow width comprising a length of plastic tubing of sufficient length to enclose the items being stored, a cylinder of rigid material sufficiently large in diameter for the items to pass through and long enough to provide storage of the length of plastic tubing

DESCRIPTION—FIGS. 1, 2, 3, 4, AND 5

Figure 1:
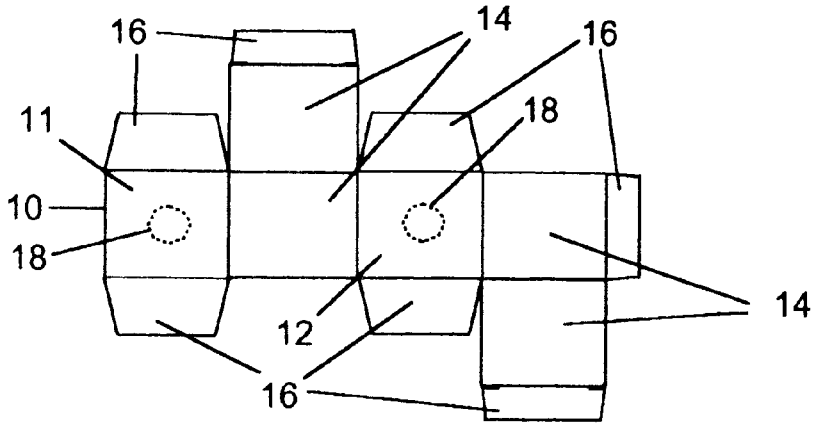
FIG. 1 shows the configuration of the rigid material used to construct a box which has perforated circles located on top and bottom of the box.

As shown in FIG. 1, the form for a box (10) is cut out with top (11) and bottom (12) being the same size (size is variable) and side sections (14) being the same size (size is variable).

The size of the box 10 may vary:

The height of the box 10 is related to the length of the compressed plastic tubing 24 and the cylinder 20 which it is designed to hold;

The width of the box 10 may vary. Most light strands can be "bagged" using a 4"×4" size box, with perforated circle 18 diameter of 1¾", and plastic tubing 24 with a flat width of 5". However, some specialty lights are quite large in size, and the box, perforated circles, cylinder, and plastic tubing must be increased in size proportionally to accommodate them. Two examples of typical sizes are as follows:

Example 1: Top 11 and bottom 12 sections being 4"×4", with side sections 14 being 4" (height)×4" (width).

Example 2: Top 11 and bottom 12 sections being 4"×4", with side sections 14 being 8" (height)×4" (width) to accommodate a longer length of tubing.

Tabs (16) used to secure the box closed are cut proportionally to size as shown in FIG. 1.

Figure 2:
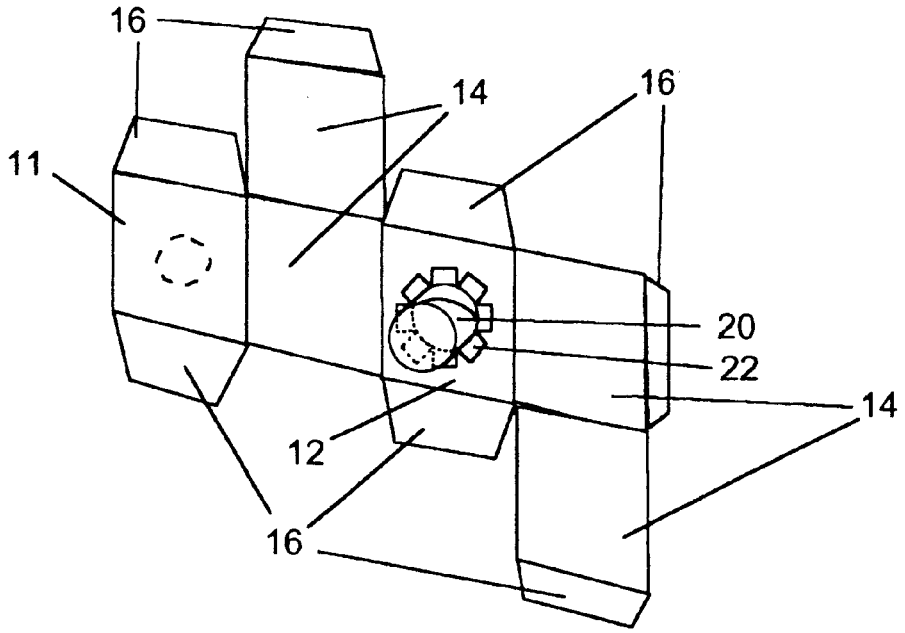
FIG. 2 shows a cylinder of rigid material mounted just larger than the perforations of the bottom circle of the configuration described in FIG. 1.

Identically sized (size is variable) perforated circles (18) are cut in the center of the top 11 and bottom 12 sections of the box. Typical size for the perforated circles 18 is 1¾" in diameter. FIG. 2 shows a cylinder of rigid material (20), approximately ¼ inch larger in diameter than the circles, attached on the inside at the bottom section of the box 12 so that it is centered around the circle 18 on the bottom of the box. The cylinder 20 is at least ½" shorter than the height of the sides of the box 14 (length of the tube and the sides may vary). The cylinder 20 is attached to the bottom of the box as shown in FIG. 2 (other methods of attachment may be used), where the bottom ½" of the cylinder 20 is cut to form narrow tabs (22) (size is variable) that can be folded out and glued to the bottom section 12 of the box 10.

FIG. 3*a* shows a length of plastic tubing (24) (size is variable) which has optional perforations around the circumference at intervals (26) (distance between the optional perforations may vary) and along the length from beginning to end (28). A length of this plastic tubing 24 is compressed (FIG. 3*b*) and mounted on the cylinder 20 (FIG. 3).

Variables:

- The length of the compressed plastic tubing 24 depends on the thickness of the plastic, the length of the uncompressed tubing, and amount of compression;
- The length of the uncompressed tubing 24 will vary. Lengths of uncompressed tubing may measure 50, 100, 200, or 300 ft, or may be an alternative length.
- The thickness of the plastic tubing 24 could vary, as could the composition of the material used to make the plastic tubing 24. Two examples are:
  - Polypropylene with a thickness of 0.001 mil having 100 slits per square inch. This is a "breathable" film similar to that used to package crusty bread for supermarket sale. This material has the advantage that light strings stored directly from use outdoors and containing residual moisture can be packaged directly and would dry during storage due to the "breathable" nature of the material.
  - Polyethylene with a thickness of 0.0015 mil can also be used.
- The interval or distance between the circumferential perforations 26 could vary. Two examples are:
  - The distance between optional circumferential perforations 26 is two feet.
  - The distance between optional circumferential perforations 26 is one foot.

The box 10 is completely assembled by fastening the tabs (FIGS. 4 and 5).

OPERATION—FIGS. 5–11

The system for packaging specialty light strings and elongated items of narrow width is used as is described below:

The perforated circles 18 in the top 11 and bottom 12 of the assembled box 10 are removed by the user (FIG. 5). The end of the plastic tubing 24 is pulled a short distance out of the top of the box (FIG. 6). One end of a string of lights (30) which has been removed from use is inserted through the hole 18 in the bottom section of the box 10 and is pushed through the cylinder 20. As the end of the light string emerges through the hole 18 in the top section 11 in the box 10, it is pulled through and out of the plastic tubing 24 which was previously drawn out of the top of the box (FIG. 7). Using a twist-tie (32), the plastic tubing 24 is then fastened to the beginning of the string of lights 30 (FIG. 8). The string of lights is then pulled through the cylinder, and the plastic tubing 24 unfolds from the cylinder and is drawn out to cover the lights. When the end of the lights is pulled through the top hole 18, the tubing is cut or is torn at the next optional circumferential perforation 26, and the end of the tubing is secured to the end of the light string by means of a second twist-tie 32 (FIG. 9*a*). The box is now ready to be used for the next string of lights (FIG. 9). The plastic-covered string of lights can now be easily coiled and stored (FIG. 10). When the light string 30 is to be used next, it is uncoiled, the twist-ties 32 removed, and the plastic tubing 24 is torn along the optional lengthwise perforation 28, or is cut, or is pulled off the light string, uncovering the lights for use (FIG. 11).

ALTERNATIVE EMBODIMENT 1—FIG. 12

To aid in use of the packaging and storage system by freeing the hands, a clip (34) for attaching the box to a belt or pocket can be attached to the box (FIG. 12*a*) The clip 34 can be made from steel (alternative materials may be used). This clip 34 would be in the form of a compressed "S", with one side flat so as to be able to be attached to one of the sides 14 of the box 10 (FIG. 12*a*). A cellophane or thin foam tape with adhesive on both sides (35) could be used to attached the clip to the box (alternative methods of attachment may be used) (FIG. 12*b*).

To use the clip with the packaging and storage system the adhesive on the cellophane or foam tape is exposed by removing any covering material, and placed on the flat part of the clip 34. The other side of the tape 35 is then attached to a side 14 of the box 10. The clip is then hung on a pocket or belt to hold the box (FIG. 12*c*), thus leaving both hands free to remove holiday lights and accessories and put them through the box 10 to be covered for storage (FIG. 12*c*).

ALTERNATIVE EMBODIMENT 2—FIG. 13

In an alternative embodiment, this system can also be built to be reusable. With the exceptions listed below, use is the same. The box portion (36) and the cylinder (40) of the Packaging and Storage System can be constructed from plastic (FIG. 13*a*). The bottom section (38) of the box 36 would be made to be removed by snapping it out of grooves along the bottom edges of the sides of the box 36. The cylinder 40 which attaches to the bottom 38 and holds the compressed plastic tubing 24 would be made of plastic and be attached permanently to the bottom section 38 (FIG. 13*b*).

When all of the compressed plastic tubing 24 in a reusable box 36 has been used, the bottom section 38 would be removed, and a new supply of compressed plastic tubing 24 inserted over the plastic cylinder 40, and the bottom section of the box snapped back on to the box (FIG. 13*c*). An alternative for this system would be to have a new disc of compressed plastic tubing 24 on a cylinder 20 which would be placed over the plastic cylinder 40 for subsequent use (FIG. 13*d*). The bottom 38 would then be snapped back onto the box 36 for use. This plastic box 10 would have cellophane tabs (42) placed over the holes 18 in the top and bottom sections of the plastic box 36 instead of using perforated circles 18 as would be used in a cardboard box. These cellophane tabs 42 would be removed prior to use.

ALTERNATIVE EMBODIMENT 3

This system can be modified to manufacturing scale and used for packaging new lights as well storing old lights. The advantage to using it for packaging new lights is that no interior plastic or cardboard storage rack would be needed, thus reducing shipping weight and saving raw materials.

ALTERNATIVE EMBODIMENT 4

This system can be modified to use shrinkwrap plastic (44) to cover the plastic tubing 24 mounted on the cylinder 20. In use, perforated center holes (46) would be torn out and the plastic sheathing 24 pulled out. The light string 30 which is to be packaged is pulled through the center hole, and the plastic tubing 24 is fastened to the beginning of the light string using a twist tie. The light string is then pulled completely through the cylinder, with the plastic tubing coming off the cylinder 20 until all of the light string has been covered with plastic tubing. The tubing is then cut or torn at an optional crosswise perforation 26, and fastened to a light string with a twist tie.

CONCLUSIONS, RAMIFICATIONS, AND SCOPE

The reader will see that the invention provides a simple and effective packaging system which is easy to use by the general public on items which are normally difficult to package and store. While the above description contains many specifications these should not be construed as limitations on the scope of the invention, but rather as an exemplification of one preferred embodiment thereof. Many other variations are possible. For example, it could be adapted to a size or style suitable for large scale commercial use for prepackaging or consumer use for larger items. The components of the box and plastic tubing can be changed in size, made of a different material, changed in shape, or made without perforating the plastic sheathing. The box can even be eliminated and replaced with a shrinkable plastic covering.

Although the description above contains many specificities, these should not be construed as limiting the scope of the invention but as merely providing illustrations of some of the presently preferred embodiments of this invention. For example, the box does not need to be square or rectangular, but could be circular. Accordingly, the scope of the invention should be determined by the appended claims and their legal equivalents, rather than by the examples given.

We claim:

1. A method for packaging specialty lighting strings and seasonal elongated items, comprising:

(a) providing a length of tubing of plastic film of sufficient length to enclose one or more of the specialty lighting strings or seasonal elongated items desired to be packaged;

(b) providing a cylinder of rigid material with a diameter sufficient for the item to be wrapped to pass through and with a length sufficient to hold said length of plastic tubing compressed onto said cylinder;

(c) providing a box of sufficient size to contain said cylinder of rigid material with the stored length of plastic tubing, with circular openings in said box concentric with said cylinder;

wherein said cylinder of rigid material is attached on the inside of the box to one side so that said lighting string or elongated item is pulled through the cylinder through the circular openings and the said length of plastic tubing is pulled off of said cylinder and over said lighting string or elongated item and fastened at each end of the lighting string or item, whereby said lighting string or elongated item may be easily packaged for storage.

2. The method of claim 1 wherein the box is made of paperboard and the circular openings are formed by cutting perforations in the sides of the box concentric with the cylinder of rigid material.

3. The method of claim 1 wherein the length of plastic tubing has perforations cut in it widthwise to facilitate cutting the length of plastic sheet once the lighting string or elongated item has been packaged.

4. The method of claim 1 wherein the length of plastic tubing has perforations cut in it lengthwise to facilitate removing the length of plastic tubing when the lighting string or elongated item is to be reused.

5. The method of claim 1 wherein the cylinder of rigid material is made of paperboard.

6. The method of claim 1 wherein the box is made of plastic and the cylinder of rigid material is made of plastic, and the compressed plastic sheathing can be replaced on the cylinder as needed.

7. The method of claim 1 wherein a clip is attached to the box where said clip will attach the box to a users belt.

8. The method of claim 1 wherein shrinkable plastic wrap is used to cover said cylinder of rigid material with compressed plastic tubing in place of a box of rigid material.

9. A hand-held system for packaging elongated decorative lights comprising a cylinder of rigid material holding a compressed length of thin flexible plastic tubing of sufficient length to enclose one or more strings of decorative lights, said cylinder being enclosed within and attached at its one end to one side of a box while leaving its other end unattached, said box being constructed from a rigid flat material foldable into a six sided box having circular holes in opposing sides concentric with said cylinder, said holes of sufficient diameter so as to allow the light strings to pass through the holes and through the cylinder inside the box, and the box sufficiently large to allow the plastic tubing to be pulled off the unattached end of the cylinder and cover the light string as the light string is manually passed through the box so as to enclose and wrap said light string for tangle-free storage.

10. The system of claim 9 wherein the box is made of paperboard and the circular openings are formed by cutting perforations in the sides of the box concentric with the cylinder of rigid material.

11. The system of claim 9 wherein the length of plastic tubing has perforations cut in it widthwise to facilitate cutting the length of plastic sheet once the lighting string or elongated item has been packaged.

12. The system of claim 9 wherein the length of plastic tubing has perforations cut in it lengthwise to facilitate removing the length of plastic tubing when the lighting string or elongated item is to be reused.

13. The system of claim 9 wherein the cylinder of rigid material is made of paperboard.

14. The system of claim 9 wherein the box is made of plastic and the cylinder of rigid material is made of plastic, and the compressed plastic sheathing can be replaced on the cylinder as needed.

15. The system of claim 9 wherein a clip is attached to the box where said clip will attach the box to a users belt.

* * * * *